United States Patent [19]

Borg et al.

[11] 4,107,253

[45] Aug. 15, 1978

[54] SAFETY AND TEST DEVICE IN A RAILWAY SIGNALLING SYSTEM

[75] Inventors: Lars Uno Borg; Lars Ragnar Kamp, both of Stockholm; Kjell Olow Ingemar Olsson, Järfälla, all of Sweden

[73] Assignee: U.S. Philips Corporation, New York, N.Y.

[21] Appl. No.: 746,332

[22] Filed: Dec. 1, 1976

[51] Int. Cl.[2] ..... B61L 3/24

[52] U.S. Cl. ..... 246/182 B; 340/146.1 BA; 235/306; 364/426

[58] Field of Search ..... 235/153 AH, 150.2, 150.24, 235/306, 308; 246/28 F, 63 R, 63 C, 182 R, 182 B, 187 R, 187 B; 340/146.1 BA, 146.1 C; 364/426

[56] References Cited

U.S. PATENT DOCUMENTS

| | | | |
|---|---|---|---|
| 3,749,994 | 7/1973 | Matty | 246/182 B X |
| 3,781,792 | 12/1973 | Birkin | 340/146.1 BA |
| 3,794,834 | 2/1974 | Auer, Jr. et al. | 246/187 B |
| 3,805,056 | 4/1974 | Birkin | 246/187 B |
| 3,876,980 | 4/1975 | Haemmig et al. | 340/146.1 BA |
| 4,017,044 | 4/1977 | Anderson et al. | 246/187 B X |

FOREIGN PATENT DOCUMENTS

| | | | |
|---|---|---|---|
| 1,403,527 | 8/1975 | United Kingdom | 340/146.1 BA |

*Primary Examiner*—Stephen G. Kunin
*Attorney, Agent, or Firm*—Frank R. Trifari; Algy Tamoshunas

[57] ABSTRACT

A safety and test device for railway signalling systems comprising a calculating device or computer adapted to treat information signals, relating to prevailing speed and desired speed, and to activate a brake device if said treatment reveals that speed reduction is necessary. In order to control itself the computer is programmed to run through special test programs, suitably sections of the ordinary program with given start data, and at the end of each such test program generate a control word, specific for each test program and coming in a given sequence. A control unit connected between the computer and the brake device receives the control words generated by the computer and compares them with correct words stored in a memory and generates an output pulse, each time an incoming control word coincides with a correct control word stored in the memory. The output pulses from the control unit are led to a magnetic winding, which, as long as it receives voltage due to pulses from the control unit, prevents braking. Braking will then be initiated by the control unit as soon as errors arise in any of the test programs resulting in generation of erroneous control words and a desired braking can also be effected via the control unit by intentionally generating erroneous control words.

6 Claims, 4 Drawing Figures

SAFETY AND TEST DEVICE IN A RAILWAY SIGNALLING SYSTEM

Figure 1:
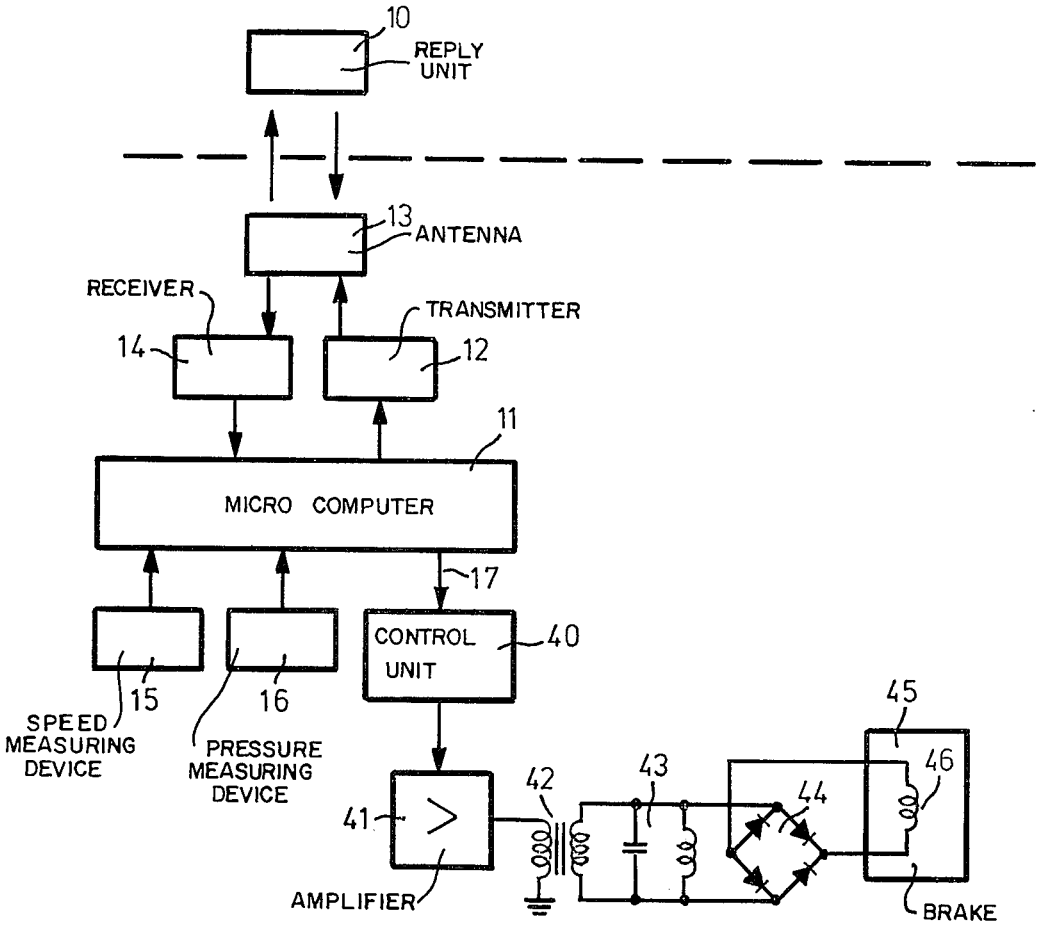

The invention relates to a safety and test device in a railway signalling system comprising a programable calculation unit or computer adapted to receive information signals relating to prevailing conditions, as prevailing speed, prevailing brake line pressure etc., and order information relating to desired conditions, for example desired speed, and which computer after treatment of the said information signals delivers output signals to activation means comprising a brake for braking the train in order to reduce the speed, if this has been found to be necessary by the treatment of the said signals, and in case of errors in the computer or in its input or output means.

The railway signalling system may for example be of the type in which information, for example relating to a certain limitation of the speed, is transmitted to an enquiry station situated in the locomotive from fixed reply units or balises by means of an unmodulated train of enquiry pulses of a very high carrier frequency transmitted from the enquiry station to the balises and a train of modulated reply pulses transmitted back from the balise to the enquiry station, the reply pulses having different frequency as compared with the frequency of the enquiry puses, for example, twice that frequency.

In such a system it is an absolute requirement that no errors can arise, which bring about that the train is run in a manner which can involve a risk if accidents. Thus there must always be supervision so that the computer by an erroneous signal treatment, or any error in the input means or output means of the computer, cannot cause such a safety risk. In view of the high amount of more or less unpredictable errors or combinations of errors, which can arise, a basic principle is that each error, which is discovered, shall lead to braking, so that the train if the error remains is brought to a stand still. Then it must be ensured that all erroneous conditions result in braking, which necessitates that both the generation of those signals, which indicate an erroneous condition, and the transmission of these signals to the brake is effected with 100% reliability.

The present invention solves this problem is that between the micro computer and the brake there is a control unit comprising a memory and a comparator, which control unit is adapted to receive control words successively generated by the computer and to compare these control words with given control words stored in the memory, and that the control unit produces an output pulse each time an incoming control word coincides with a control word in the memory and arrives in a sequence determined by the memory, which pulses from the control unit are fed to a magnetic winding which keeps the brake in an unactivated condition, and that the computer is adapted to, in a cyclically repeated sequence, run through predetermined program sections and at the end of each such program section generate one of the said control words in the given sequence.

In order to achieve the best possible supervision of the operation of the computer itself the test programs may suitably be formed of different sections of the ordinary program, which the computer has to run through when it treats actual values (desired values and prevailing values) in order to determine if any regulation, for example a braking operation, is required or not. The control word may then be formed by the final word obtained at the end of such a program section with given starting data, if desired, after required conversion of this final word, if the control words have to be of any special shape, for example be a so called Hamming code. The given control word then will be generated only if all parts of the actual program section have been carried through correctly; each error in any part of the program section results in a different control word, whereby the pulses from the control unit will cease and braking is initiated.

In order to achieve maximum safety for inhibiting any error in the transmission path between the control unit and the brake from being able to prevent braking, the output pulses from the control unit are, suitably after conversion to a symmetric AC-voltage and amplification, transferred to the magnetic winding of the brake through a transformer with a following rectifier. Hence, errors in the signal path between the control unit and the transformer, such as, for example, a short circuit in the amplifier, can not prevent the brake from being activated since the brake is maintained in a deactivated condition by a constant voltage supplied to its magnetic winding. Any error in the path will thus interrupt the current in the magnetic winding and activate the brake.

The invention is illustrated in the accompanying drawings, in which

Figure 2:
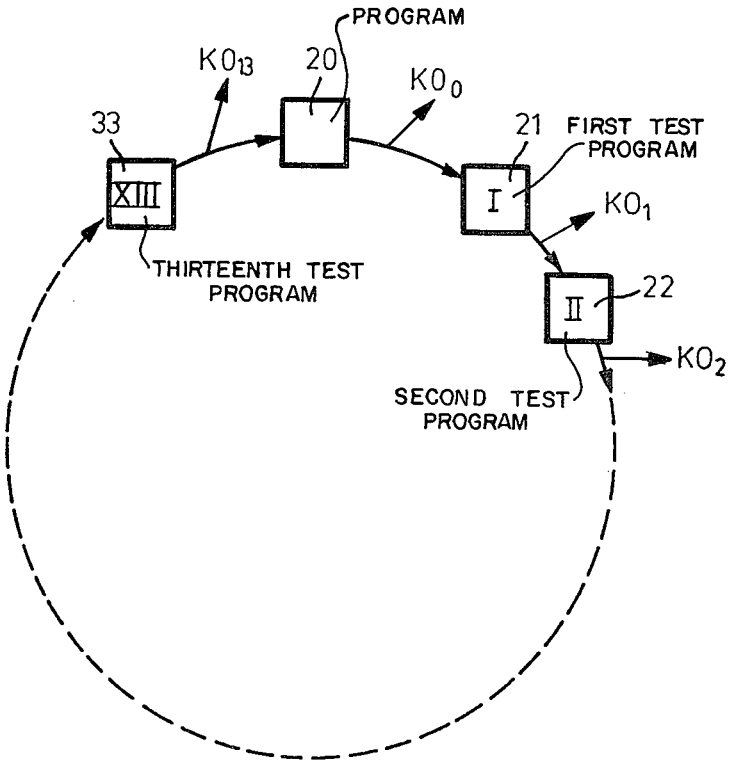
Figures 3, 4:
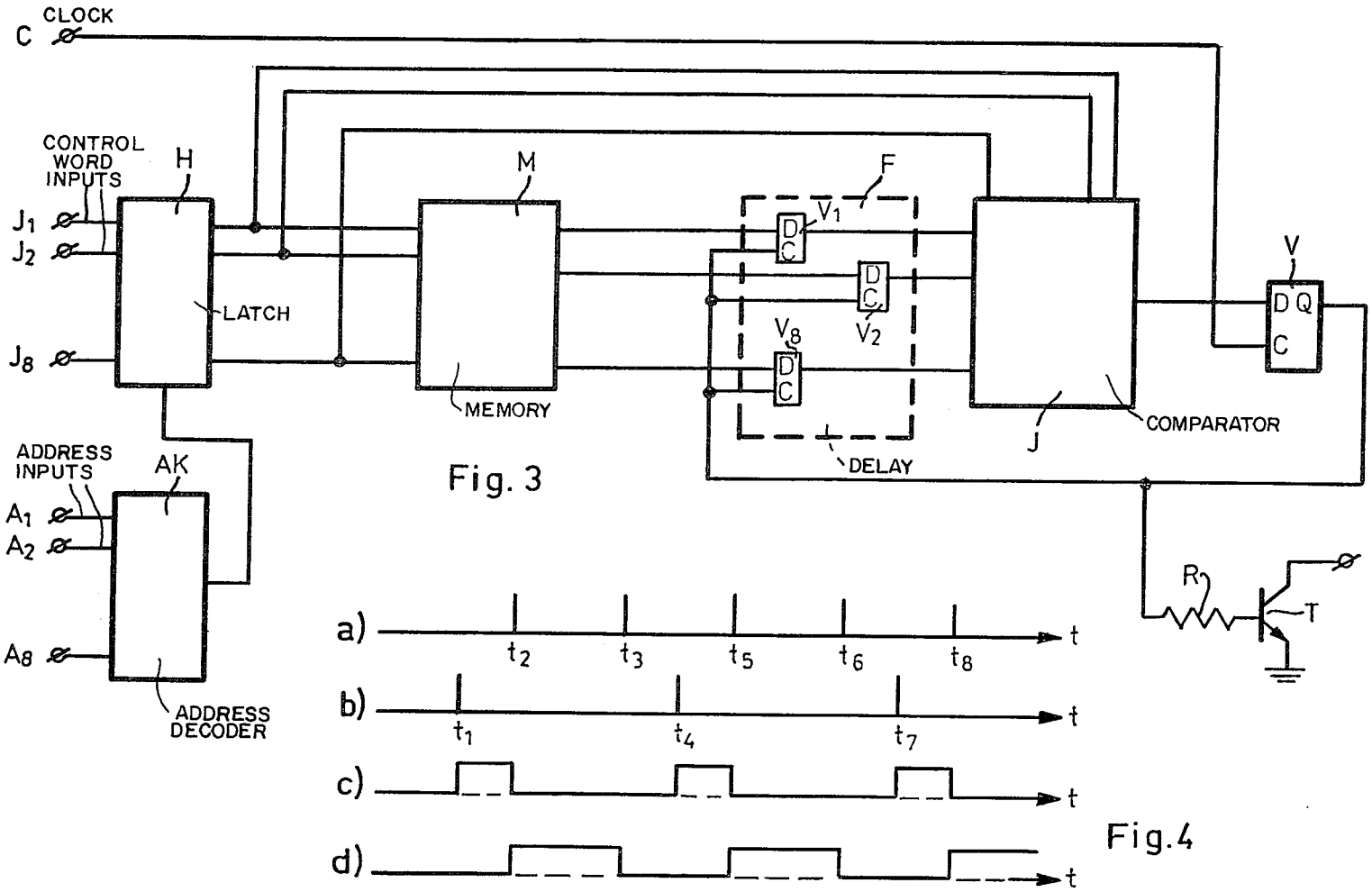

FIG. 1 shows a simplified block diagram for a train signalling system in which a safety and testing device according to the invention is included, FIG. 2 shows a schematic diagram for the operation of a micro computer included in the system according to FIG. 1, FIG. 3 shows a block diagram for a control unit included in the system and FIG. 4 shows some time diagrams for explanation of the function of the control unit according to FIG. 3.

The shown and described system can operate in a manner and be adapted to transmit information, for example relating to desired speed, from a fixed reply unit or balise to an enquiry station arranged in a locomotive. In the enquiry station treating circuits are arranged for treating the obtained information and furthermore there are measuring instruments for measuring prevailing conditions and actuation means comprising a braking device for effectuating required regulation.

The reply unit or the balise, is in FIG. 1 shown by the block 10 above the dotted line, while the enquiry station with treating circuits, measuring instruments and actuation means is shown below the dotted line.

A micro computer 11, which via a transmitter 12 and an antenna 13 controls the transmission of enquiry pulses to the balise, serves as a control and treating device in the enquiry station. The enquiry pulses have the form of an unmodulated pulse train and can be transmitted on a very high carrier frequency. The reply pulses, which for example are transmitted with the double carrier frequency as compared with the frequency of the enquiry pulses, are re-transmitted from the balise and are received by the antenna 13. The reply pulses form a pulse train, in which the individual pulses are modulated to a binary 1 or a binary 0 in accordance with the information to be transferred. The reply pulses are led from the antenna 13 to a receiver 14, in which binary 1 is separated from binary 0. Thereafter the binary pulses are led from the receiver 14 to the micro computer 11. The micro computer 11 is also connected to a number of input means which are represented in FIG. 1 by a speed measuring device 15 and a pressure measuring device 16. The speed measuring device 15 delivers a signal to the micro computer, which indicates the prevailing speed, and the pressure measuring device delivers a signal, which indicates the prevailing pressure in the braking line.

The micro computer is programmed to run through a predetermined program with even intervals, according to which the information obtained from the balise relating to the desired condition, for example desired speed, is treated together with the information obtained from the measuring instruments relating to prevailing conditions. The treatment of the information fed to the micro computer either results in that the prevailing condition coincides with the desired condition or that a regulation must be made for achieving such coincidence. In the same last case the computer is adapted to deliver output signals to the actuation means, for example the brake, which effects the desired regulation.

In order to ensure that errors in the computer itself or in its input or output means cannot result in any dangerous conditions, the micro computer is according to the invention adapted to in the time spaces between the said intervals, when the computer treats real signals relating to desired and prevailing conditions, successively run through a number of predetermined test programs, which only have for their purpose to supervise or test the computer and/or its input or output means. As a result of each such test program a predetermined binary or "control word" is obtained from the computer at an output 17, if the test program has been run through correctly. If any error has occurred a different word as compared with the predetermined control word will be obtained at the output 17.

The function is illustrated in FIG. 2, which shows a coarse functional diagram for the micro computer 11. The block 20 represents the said predetermined program, when the computer treats real values (desired values and prevailing values) and possibly orders a desired regulation, for example of the speed and pressure in the brake line. Should the treatment of the real values give to result that any braking is not necessary the first control word, designated with $K_o$ in FIG. 2, is generated at the end of the program. The computer then automatically starts to carry through the first test program, designated with I and represented by the block 21 in FIG. 2. If the test program I is run through correctly the second control word $K_I$ in the predetermined sequence of control words is generated on the output 17 at the end of the program. The computer then in similar manner automatically starts to carry through the next following test programs, designated II, III etc. in FIG. 2 and represented by the blocks 22, 23 etc. For each test program a control word $K_{II}$, $K_{III}$. . . included in the given sequence of control words is generated on the output 17 at the end of the program, if the program has been carried out correctly. If any error should be present in the tested part of the computer or in its input- or output means a different word will be generated at the output 17, which is not included in the given sequence and thus in reality is no control word. In the given example thirteen test programs are run through and after the thirteenth and last test program, designated with XIII in FIG. 2 and represented by the block 33, the computer again starts to run through the main program with treatment of real values and the procedure is repeated.

The control words used in the present case are the so called Hamming codes comprising eight bits with exception of those codes, which only have zeros and only ones, which gives a total of fourteen codes. The advantage with these Hamming codes is that at the transition from one Hamming code to another, four bits must always be changed. Thus, four erroneous bits must always appear simultaneously in order for an erroneous code to be apprehended as a correct code. A Hamming code test equipment may be arranged for detecting whether correct Hamming codes are fed out on the output 17 and to give an alarm if an erroneous code is fed out.

The control words are according to FIG. 1 fed to a control unit 40, which comprises addressable memory for the correct control words and a comparator for comparing incoming control words with the control words in the memory. For each correct control word, which arrives in the given sequence, the control unit generates an output pulse, which pulse after being shaped to a symmetric rectangular voltage are fed to an amplifier 41 and from there led to the primary side of a transformer 42. From the secondary side of the transformer 42 the AC voltage is led through a band pass filter 43 to a rectifier 44 and the rectified voltage is finally led from the rectifier 44 to a brake magnetic winding 46 in a brake device, which is schematically indicated by the block 45. The brake device is so constructed that no braking is effected as long as current is fed through the winding 46, while as soon as the current through the winding 46 ceases braking will be effected.

The function of the device shown in FIG. 1 is that the computer all the time successively runs through the programs schematically indicated in FIG. 2 and for each such program, which has been run through correctly, generates a control word in the given sequence. As long as current control words arrive in the given sequence an alternating voltage is obtained from the control unit and current is driven through the winding 46, whereby braking is prevented. Should, however, an erroneous "control word" be fed out from the micro computer at the end of a test program, for example test program 1, no new re-addressing of the in the control unit will take place memory the control word, in the given example $KO_1$, which should have appeared at the end of the test program, which resulted in the erroneous final word, will remain in the memory as a comparison word. The following control words arriving from the micro computer will be compared with this control word and the comparison then will result in unequality, even if the following control words are correct. No pulses are produced by the control unit and no alternating voltage is obtained from the unit. The current supply to the brake winding will cease and braking is initiated. However, the computer will continue its operation and will after a whole operation cycle again arrive at the test program, which previously gave the erroneous final word. The correct control for this test program is, as mentioned earlier, still addressed as a comparison word in the control unit. Should the correct control word appear at the end of the test program, at this time voltage pulse will be obtained from the control unit and the memory is re-addressed to a new position, where the next control word in the given sequence is stored. Provided that the following control words also are correct the voltage from the control unit will reappear and the braking is interrupted. The time constant in the brake system can then be such that one single erroneous control word does not give rise to any noticable braking effect. Should, however, the error remain and the following tests also give rise to erroneous control words, braking will be effected at the same time as an indication is obtained as to which test program it was that resulted in the erroneous control word.

The generation of control words in the micro computer can be effected in different ways. In order to achieve the best possible supervision of the computer, the control words, however, always should be generated under normal operation conditions in the computer and in dependence upon the fact that the selected functions have been carried out correctly. The simplest way to generate the control words is to let the said test programs I, II, III . . . XIII be different sections of the ordinary program with given start data for each program section. Each such program section with given start data will give as a final word one single predetermined word, if the system has functioned correctly. The said start data then can be selected such that the final word for each program section will be a Hamming code. Alternatively an additional conversion stage can be included after the running through of the actual program section, in which conversion stage the obtained final word is converted to a Hamming code. The different test programs then will supervise different parts of the computer.

According to another alternative a special code generation is effected in the computer at the running through of the test programs, which code generation as final result gives a control word. Even in this case the computer should realize such instructions, which are included in the ordinary program, and the code generation then can be effected in parallel with this normal operation of the computer. Each sub-operation in the computer then can result in a code which on the one hand is dependent on how the actual sub-operation has been carried through and on the other hand on the code generated during the foregoing sub-operation. At the end of the test program a code is then obtained, which is dependent upon all sub-operations in the computer during the actual test program and which code forms the control word.

An embodiment of the control unit in a device according to the invention is shown in FIG. 3. The unit comprises a latch circuit H with input terminals $J_1$, $J_2$. . . to which terminals the said control words from the micro computer are fed. The latch circuit H receives control signal from an address decoder AK, having a number of inputs $A_1$, $A_2$. . . To these inputs $A_1$, $A_2$. . . a special address code is applied, which code is associated with each control word. When the decoder detects this address code on the inputs $A_1$, $A_2$. . . it produces a signal to the latch circuit H so that those bits, which represent the word which simultaneously appears on the inputs $J_1$, $J_2$. . . , will pass into the latch circuit, where the word is maintained until the next control word with following address code arrives. The word in the latch circuit H appears on the output of the circuit and is therefore applied on the one hand to a comparator J and on the other hand to a memory M which may be a ROM and contains the correct control words. The arriving control word appearing at the output of the latch circuit H is led to the address input of the memory M and determines the position in the memory, which is read out. For each address, determined by the control word, appearing at the output of the latch circuit H the word, which is stored in the position given by the address, will appear at the output of the memory. The memory M is then so constructed that, when a certain control word appears at the input, the next following control word in the given sequence appears always at the output of the memory. The outputs of the memory are connected via a delay unit F to a second group of inputs of the comparator J. The delay unit F comprises a D flip-flop $V_1$, $V_2$. . . for each output from the ROM memory M, which outputs are connected to the D input of the respective flip-flop. The comparator J is adapted to compare the word obtained from the output of the latch circuit H with the word obtained from the outputs of the delay unit F and to deliver a signal, when the compared words are equal. It is for example assumed that the voltage from the comparator J is low when the compared words are different and is high when the words are equal. The output signal from the comparator J is led to the D input of a D flip-flop V, which receives clock pulses C at its clock input. The D flip-flop V has for its purpose to reshape the signal appearing at the output of the comparator J to a symmetric alternating voltage and its output signal is led via a resistance R to an output amplification transistor T, which delivers the output voltage of the control unit. The output voltage from the D flip-flop V is also led to the clock input of the D flip-flops $V_1$, $V_2$. . . included in the delay unit F.

The function of the device will now be explained with reference to the time diagrams shown in FIG. 4. In FIG. 4 the uppermost diagram(*a*) shows the clock pulses C, which are led to the D flip-flop V, the next diagram (*b*) shows pulses, which represent the control words from the micro computer, the diagram (*c*) shows the output voltage from the comparator J and the diagram (*d*) shows the output voltage from the D flip-flop V. In the example it has been assumed that the frequency of the clock pulses C is twice the frequency of the control words.

In the initial condition it is assumed that a control word, more particularly the last control word received from the computer, is available at the output of the latch circuit H, whereby the next following control word in the given sequence appears at the outputs of the memory M. It is also assumed that the delay time of the delay unit F has elapsed so that the said last control word also appears at the output of the delay unit and thus is fed to the inputs of the comparator J. Thus, the comparator has two different words on its inputs and the output voltage from the comparator is low. This low voltage also appears at the output of the D flip-flop V.

When the first control word in the sequence under consideration arrives at the moment $t_1$, this control word, if it is correct, is equal to the control word, which appears at the outputs of the delay unit F and the output voltage from the comparator J will be high. The new control word appearing at the output of the latch circuit H also produces re-addressing of the memory M and the next following control word in the given sequence will be fed out from the memory. This control word is, however, for the moment, not led further to the comparator due to the action of the delay unit F. The high output voltage from the comparator passes to the D input of the D flip-flop V but the said flip-flop remains in its rest condition and no change takes place in the output voltage of the flip-flop V. When a clock pulse C thereafter appears and arrives to the D input of the flip-flop V, the voltage on the said input is fed out to the output of the flip-flop, whereby thus the output voltage from the flip-flop V will be high (see the lowest diagram in FIG. 4). The positive edge of the output voltage of the D flip-flop V serves as clock pulse for the D flip-flops included in the delay unit F and the voltages appearing at the D input of the said flip-flops representing the next following control word in the given sequence are led to the outputs of the flip-flops and to the comparator J. The equality in the comparator J disappears and the output voltage from the comparator will be low. Due to the fact that the frequency of the clock pulses is twice the frequency, with which the control words appear, a further clock pulse C will arrive before a new control word arrives. When this next following clock pulse arrives in the moment $t_3$ the low voltage from the comparator J is fed to the output of the D flip-flop V, the output voltage of which thus changes from high level to low level. When a new control word thereafter arrives at the moment $t_4$, the voltage from the comparator J will be high, if the control word is correct, but this high voltage will not immediately pass to the output of the D flip-flop V. Not until the next following clock pulse arrives, moment $t_5$, the voltage from the D flip-flop V will be high at the same time as the output voltage from the comparator J will be low so that the next following control word is applied to the comparator J and the equality in the same thus disappears. The procedure is repeated and as long as correct control words arrive in the given sequence, a symmetrical alternating voltage is produced at the output of the D flip-flop V, which voltage after amplification in the transistor T is led to the magnetic winding of the brake.

If an erroneous control word should arrive from the computer the memory M will be previously mentioned not be re-addressed but the control word, which should have appeared at the end of the erroneous test program, will remain at the output of the memory. Also the following comparing operations in the comparator J then will show unequality and the voltage from the control unit ceases. Braking will be initiated. If the error remains braking will take place after a certain time.

Braking is thus not effected as soon as a remaining error appears in any of the test programs. The braking, which is to take place on basis of the received information and the treatment of this information taking place in the block 20 in FIG. 2, when the computer works with real values in its ordinary program, can suitably also be effected by means of the described control unit. When the treatment of the said information shows that a reduction of the speed is necessary the micro computer can be programmed to instead of the correct control word ($KO_O$ according to FIG. 2) fed out an erroneous control word. Feeding out of erroneous control words continues until the micro computer finds that braking is no longer necessary. Then it feeds out the correct control word ($KO_O$) and provided that no errors appear during the test program the braking will cease.

What is claimed is:

1. In a safety and test device in a railway signalling system comprising computer means having output means and input means for receiving information signals relating to prevailing and desired operating conditions such as prevailing speed, prevailing brake line pressure and desired speed, said computer means being adapted to treat said information signals in accordance with a predetermined program and to produce output signals for application to activation means comprising a brake for braking a train in order to effect speed reduction determined to be necessary by the treatment of said information signals, the improvement wherein the computer means is adapted in a cyclically repeated sequence to run through test program sections and at the end of each such program section to generate a control word, and comprising a control unit adapted to receive said control words successively generated by the computer means, said control unit being connected between the computer means and the activation means and including a memory for storing predetermined control words in a given sequence, a comparator for comparing the control words received from the computer means with said predetermined control words stored in said memory, means for producing an output pulse each time a received control word coincides with a control word stored in said memory and is received in said given sequence, and means for feeding said pulses from said control unit to a magnetic winding which keeps the brake in an unactivated condition, said computer means being further adapted to generate a further control word which is included in the given sequence of control words, said further control word being generated at the end of said predetermined program if the treatment of said information signals indicated that braking is not to be effected, while if the treatment of the said information signals indicates that braking is to be effected said further control word is not generated or an erroneous control word is generated so that braking will be effected via said control unit due to disappearance of said output pulses.

2. In a safety and test device in a railway signalling system comprising computer means having output means and input means for receiving information signals relating to prevailing and desired operating conditions such as prevailing speed, prevailing brake line pressure, and desired speed, said computer means being adapted to treat said information signals in accordance with a predetermined program and to produce output signals for application to activation means comprising a brake for braking a train in order to effect speed reduction determined to be necessary by the treatment of said information signals, the improvement wherein the computer means is adapted in a cyclically repeated sequence to run through test program sections and at the end of each such program section to generate a control word, and comprising a control unit adapted to receive said control words successively generated by the computer means, said control unit being connected between the computer means and the activation means and including a memory for storing predetermined control words in a given sequence, a comparator for comparing the control words received from the computer means with said predetermined control words stored in said memory, means for producing an output pulse each time a received control word coincides with a control word stored in said memory and is received in said given sequence, means for converting said pulses to a symmetric alternating voltage and means for feeding said alternating voltage via a transformer with a following rectifier to a magnetic winding which keeps the brake in an unactivated condition.

3. A device as claimed in claim 2, wherein said tst program sections form different parts of said predetermined program so that the computer means runs through said test program sections during the time intervals between said treatment of said information signals.

4. A device as claimed in claim 3, wherein the control word is the final word obtained by the running through of said test program sections with given fixed start data.

5. A device as claimed in claim 2, including a band pass filter connected between the transformer and the rectifier, said band pass filter being tuned substantially to the frequency of said alternating voltage.

6. A device as claimed in claim 2, wherein the control unit includes means for feeding said control words received from the computer means directly to the comparator and to address inputs of the memory, which then at its output delivers the next following control word in the given sequence, and a delay unit connected between the output of the memory and a second input of the comparator for delaying the supply of the next following word to the comparator until the comparison of the previous control word with the corresponding control word in the memory is finished.

* * * * *

UNITED STATES PATENT OFFICE

CERTIFICATE OF CORRECTION

Patent No. 4,107,253 Dated August 15, 1978

Inventor(s) Lars Uno Borg et al

It is certified that error appears in the above-identified patent and that said Letters Patent are hereby corrected as shown below:

Col. 8, line 63, After "said" delete "tst" and insert -- test --

Col. 10, line 6, After "following" insert -- control --

Signed and Sealed this

*Twenty-seventh* Day of *January 1981*

[SEAL]

*Attest:*

RENE D. TEGTMEYER

*Attesting Officer*

*Acting Commissioner of Patents and Trademarks*